US007411121B2

(12) United States Patent
McGill

(10) Patent No.: US 7,411,121 B2
(45) Date of Patent: Aug. 12, 2008

(54) STRING ENERGY TRANSFERENCE FOR STRINGED MUSICAL INSTRUMENTS

(76) Inventor: Paul McGill, 808 Kendall, Nashville, TN (US) 37209

( * ) Notice: Subject to any disclaimer, the term of this patent is extended or adjusted under 35 U.S.C. 154(b) by 0 days.

(21) Appl. No.: 10/136,634

(22) Filed: May 2, 2002

(65) Prior Publication Data

US 2004/0050235 A1 Mar. 18, 2004

(51) Int. Cl.
*G10D 3/00* (2006.01)

(52) U.S. Cl. ..... 84/291; 84/267

(58) Field of Classification Search ..... 84/291, 84/267, 290, 274, 275
See application file for complete search history.

(56) References Cited

U.S. PATENT DOCUMENTS 2,660,912 A * 12/1953 Prescott ..... 84/291
4,291,606 A * 9/1981 Lepage ..... 84/291
4,741,238 A * 5/1988 Carriveau ..... 84/291

* cited by examiner

*Primary Examiner*—Lincoln Donovan
*Assistant Examiner*—Jianchun Qin

(57) ABSTRACT

A guitar or applicable musical instrument is improved to enhance string energy through integration of side materials and structural spanners to maintain the integrity of the instrument under load of string tension. The invention improves ampliphonic efficiency by protecting the resonating surface of the instrument's soundboard from compression and distortion, stabilizes the harmonic mode of the neck as it rocks in and out of the sound hole area, and decreases loss of string energy. By stabilizing the neck and body structure, a long-term consistency in the neck alignment to the body is preserved. The soundboard efficiency is improved by extending the string load on the structure to the butt end of the instrument, allowing for a greater portion of soundboard area to be de-stressed when under string load.

22 Claims, 6 Drawing Sheets

STRING ENERGY TRANSFERENCE FOR STRINGED MUSICAL INSTRUMENTS

FIELD OF THE INVENTION

The present invention relates to a stringed musical instrument, such as an acoustic guitar, having sound improving features, and a method for producing the improved string instrument.

BACKGROUND OF THE INVENTION

As well known in the art, an acoustic guitar has (1) several tensioned strings that, when vibrated, produce sounds of desired tone and frequency, and (2) a resonance cavity positioned proximate to the strings to modify and amplify the sounds. In comparison, an electric guitar typically lacks a resonance cavity and relies, instead, upon electrical amplification and modification of the strings' sound. Within this disclosure, the term "guitar" is used to refer generally to an instrument having a resonating cavity, including the above-defined acoustic guitars and electric/acoustical guitars that use electrical circuitry to modify sound from the resonance cavity.

For several centuries, instrument builders have constructed guitars using the same basic design. In particular, a guitar has a body section with a smaller upper bout and a larger lower bout that are separated by a narrower waist area. The body is constructed with a braced top panel and back panel, as well as bent side ribs connecting the top and back panels. The top has a sound hole, usually a round opening near the center of the top. The design also has a cantilevered arm, known as a neck, that extends from the body at a neutral position of the upper bout. Strings attach to a distal end of the neck, called a head. The neck is typically fretted to a musical scale with a fret board attached over the neck and body and ending proximate to the sound hole. The top holds a coupling device, or bridge, at which the strings attach to the top. In this configuration, the strings extend from the distal end of the neck, over the fret board and sound hole, and attach to the bridge to create a medium through which the acoustic qualities of the design can be exploited for the purpose of making music. For example, the body forms the resonance cavity to modify and amplify the strings' sounds. The body can be modified as necessary to achieve desired tonal qualities.

The strings are kept at relatively high tensions, and accordingly, they apply a strong compressive force between the neck and the bridge. However, the above-described general guitar structure has an inherent weakness created by the positioning of a sound hole intermediary to the ends of the strings, where compression force can compress the cantilever action of the neck and cause the formation of a frequency mode in the neck. This structural defect dampens string energy by compromising the stability of the locations to which the strings are attached. The resulting flexibility further causes long-term structural weakness. The sound hole lacks sufficient strength to resist the string tension and deforms over a long period of time. In fact, the sound hole of guitars may shift measurably in shape from a round circle to an oval. The deformation of the sound hole causes shifts the placement of the neck, altering the neck's alignment relative to the body and adversely effecting the instrument's sound qualities.

In order to secure the guitar structure under the compressive force from the strings, the body is generally reinforced according to several different methodologies known in the art. For example, it is known to increase the strength of the guitar body by increasing the strength of the side ribs and/or back through the use of thicker, laminated sheets of materials. Guitar builders have also used laminated side ribs and back to alter sound qualities of the instrument. However, the use of thick, laminated materials makes the guitar undesirably heavy. For example, a laminated side typically has two, three or even 4 plies, adding considerable mass to the instrument. A guitar assembly with non-laminated sides requires a top and back liner, and guitar assembly having laminated sides further requires reinforcing strips or linings glued along the top and the back. Increasing the number of parts makes the guitar relatively more expensive to build because added parts requires added steps in construction and more labor is required.

One known guitar assembly that uses laminated sides is the guitar design of Greg Smallman, a well-known Australian guitar builder. As illustrated in FIG. 1, this design features a heavy, laminated structure that fits inside a surrounding side assembly and a soundboard that attaches to the composite structure to form the top of the guitar body. The composite structure has cutouts to redo weight and to modify the guitar's tonal qualities, including a large cutout in the larger, lower bout of the laminated structure that unencumbers the relatively flexible soundboard from the more solid laminated structure and creates a functional area in which the soundboard resonates to amplify string vibrations. The guitar assembly is further reinforced by gluing two heavy beams at angles between the narrow waist air of the guitar and the bottom end of the instrument at the lower bout center. These beams stabilize the guitar assembly structure to protect the necessarily thin and fragile soundboard from a distortion or movement in the composite side assembly after the instrument is fully loaded with string tension. The design contains many novel innovations to traditional designs to improve the guitar's tonal qualities. For example, the guitar's thin soundboard that is very thin at a functional air near the lateral region where the top connects to the side. This thinness loosens the soundboard to allow it to vibrate more freely relative to the side pieces, creating a guitar having greater volume and tone. However, this weakness of the soundboard requires great reinforcement of the guitar assembly so that the guitar assembly may withstand the compression forces of the strings. Otherwise, the leveraging of the guitar's cantilevered neck distorts the body structure under string tension, potentially distorting or fracturing the soundboard. A guitar produced using this design has improved sound quality over traditional guitars. However, this design for a guitar has several limitations. For example, the laminated structure of the soundboard covers so much area that the sound board limits and closes off the available space required for most standard soundboard reinforcement design, or bracing patterns. The reduced area of the laminated soundboard also requires a thinner top perimeter to loosen the soundboard, as needed for increase amplitude. Another limitation of the design is that the reinforcement beams, describe above, only add support for the lower bout of the instrument. Furthermore, the use of the laminated structures to achieve structural integrity makes the resulting instrument very heavy. As a result, there exists a current need for an improved guitar body in which the soundboard is allowed to resonate as needed to produce desirable sound quality without incurring these limitations.

In another known methodologies to reinforce the guitar body, a reinforcing counter-leveraging member is positioned through the guitar body at a midpoint between the top and back. For example, U.S. Pat. No. 3,435,721, issued to Dopera, describes a guitar assembly having an integrated neck extension that extends through the body and is counter-positioned by jacks against the guitar back. Similarly, the Larson Brothers, who produced and marketed guitars and other string instruments under many different names in the first half of the 20th century, installed a reinforcing metal tube through the body, halfway between the back and top. The metal tube was anchored to structural blocks at the neck and a butt end of the guitar body, opposing the neck. However, in the methodologies taught by Dopera and the Larson brothers, the placement of a counter leveraging member through the body at a mid point between the top and back is geometrically deficient to protect the sound hole from load because the leverage force of the neck fulcrums at the plane of the top and is most efficiently countered there.

Furthermore, all of the above-described reinforcement methods are either deficient mechanically, lacking well planned integration of parts, or are complex structures that are difficult to build. In addition, known design for reinforcing a guitar body do not directly addresses and remedy the distortion created by the loading of the neck on the side assembly as an independent unit leaving the top structure to carry to load in tandom with the side structure. Also, none of the known designs for reinforcing a guitar body adequately address the needs of the top's primary ampliphonic function. Therefore, there exists a current need for an improved methodology for reinforcing the structure of the guitar body.

SUMMARY OF THE INVENTION

These and other needs are addressed in the present invention through an improved string instrument assembly for a guitar or similarly applicable musical instrument that has provides enhanced string energy. The improved string instrument assembly includes the integration of side materials and structural spanners to maintain the integrity of the instrument under load of string tension. The string instrument assembly invention improves ampliphonic efficiency by protecting the resonating surface of the instrument's soundboard from compression and distortion caused by the instruments resistance to load under tension of strings. The string instrument assembly also stabilizes the harmonic mode of the neck as it rocks in and out of the sound hole area and decreases the loss of string energy. The string instrument assembly further improves the efficiency of the sound board by extending the string load on the structure to the butt end of the instrument, allowing for a greater portion of soundboard area to be destressed when under string load.

BRIEF DESCRIPTION OF THE DRAWING

Referring now to the drawings in which like reference numbers represent corresponding parts throughout.

DETAILED DESCRIPTION OF A PREFERRED EMBODIMENT OF THE INVENTION

Figure 1:
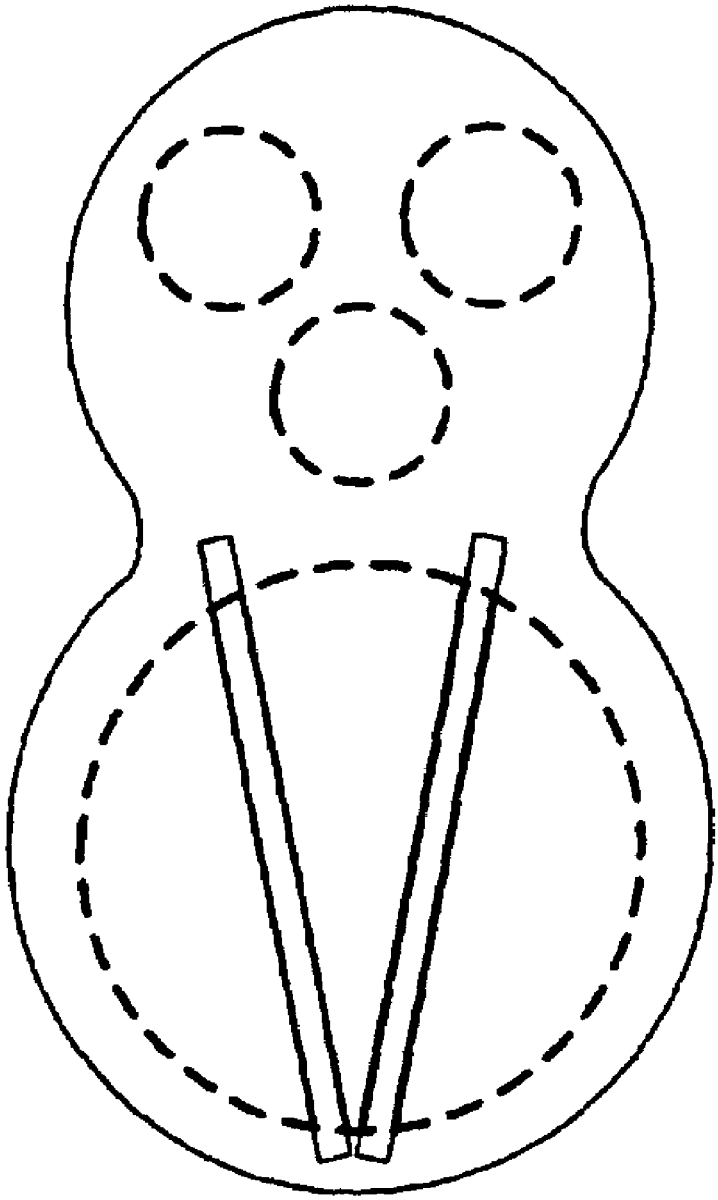
Prior Art Figure 1
FIG. 1 (Prior Art) is an illustration of a known guitar.
Figure 2:
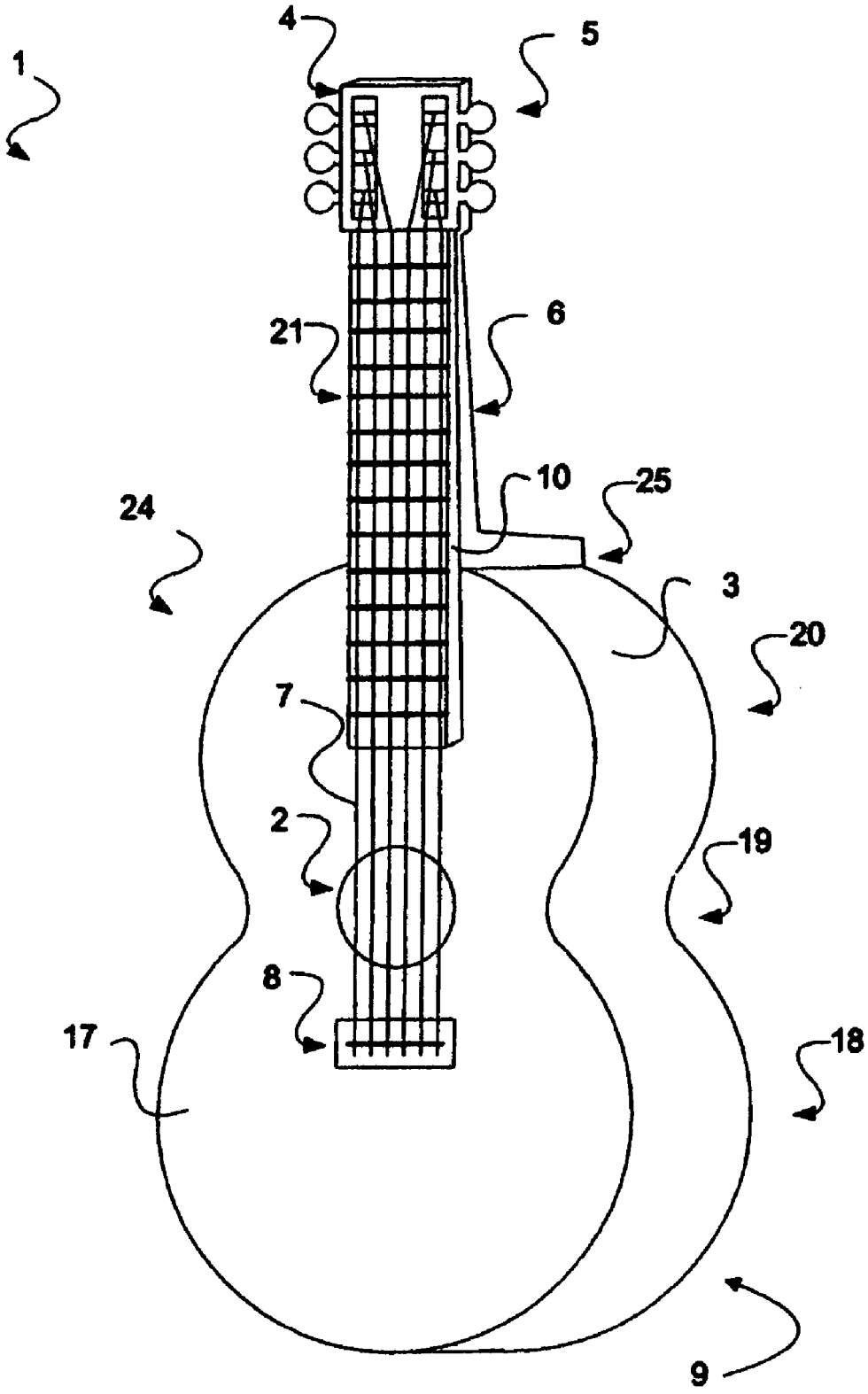
FIGS. 2-6 are illustrations of an instrument assembly in accordance with various embodiments of the present invention.

The present invention's improved string instrument assembly is illustrated in FIGS. 2-6, which show an instrument 1. In particular, FIG. 2 illustrates the instrument 1, a guitar or related instrument, having a body 24 with a lower bout 18, a waist 19 and upper bout 20. Centrally affixed to a top 17 is a bridge 8 to which a proximal end of strings 7 are attached. The instrument 1 includes a neck 6 that is attached to the body 24 at a central point of the upper bout 20. The neck 6 extends off of the body 24, as needed for the performance of the instrument 1. Laminated to the neck 6 and extending over the body 24 is a fret board 10 having attached frets 21 to provide a musical scale for the strings 7 when the instrument 1 is played. At a distant end of the neck 6, as it extends from the body 24, is a head stock 4. Typically, the head stock 4 has attached, rotatable tuning keys 5 for the purpose of securing the distal end of the strings 7 and tensioning the strings 7 as required for playing the instrument 1 in tune.

Figure 6:
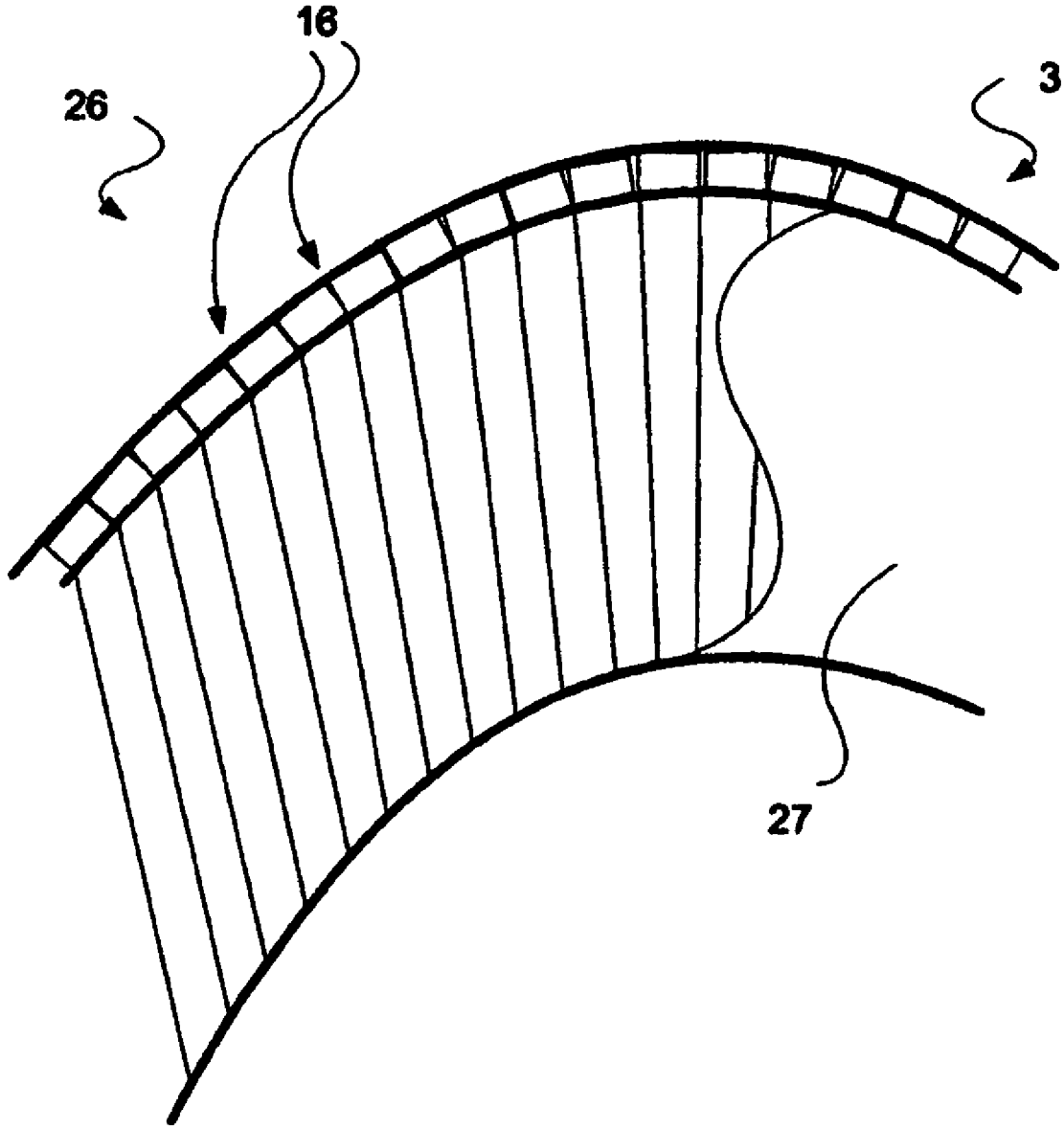

As illustrated in FIGS. 2 and 6, the body 24 is formed by attaching the perimeter of the top 17 to a laminated side structure 26. The side structure 26 extends away (in depth) from the top 17 some distance, where it is joined to a back 9. To further integrate the neck 6 and the body 24, the neck 6 has a heel 25 that extends down the laminated side structure 26 to the back 9, providing a further connection surface to secure the neck 6 to the body 24. The laminated side structure 26 is generally composed from the combination of an outer side laminate 3 and an inner side laminate 15. In a preferred implementation, the outer side laminate 3 is a hardwood, such as maple, rosewood or Mahogany etc., of approximately 0.060-0.080 of an inch in thickness, and the inner side laminate 15 is a softwood, such as red cedar, bass wood, spruce, etc., of approximately 0.200 of an inch in thickness. On an inner surface, the inner side laminate 15 may have multiple kerfs 16 (cut slots), which extend substantially between the top 17 and the back 9 as needed to provide flexibility to the inner side laminate 15. In this way, the inner side laminate 15 may be manipulated and bent to closely fit the shape of the outer side laminate 3. An outer, non-kerfed side skin of the inner side laminate 15 attaches to an inner surface of the outer side laminate 3 to form the laminate side structure 26. The resulting laminate side structure 26 is lightweight, yet sufficiently rigid, due to continuous fibers that run the length of the laminate side structure 26 from end to end. The resultant laminate side structure resists distortion of the top 17 from stresses that may occur in the instrument 1. This construction of the laminate side structure 26 is further advantageous because the instrument can be constructed with less parts and labor. In particular, a builder may form the laminate side structure 26 in a single bending and gluing operation, and the laminate side structure 26 is wide enough to glue the top 17 and back 9 without the use of additional structural elements. In contrast, known guitar assemblies generally use multiple narrow kerfed or solid lining strips that are bent and glued to the sides to create greater gluing surfaces for attaching the top and back. Another benefit of the laminate side structure 26 is the strong connection of the outer side laminate 3 and the inner side laminate 15, which provides a permanent lock to hold together the two laminates, 3 and 15. This connection helps prevent the outer side laminate 3 from springing back to its original, unbent shape and relieves the top 17 from performing that function after the instrument 1 is constructed.

Figure 3:
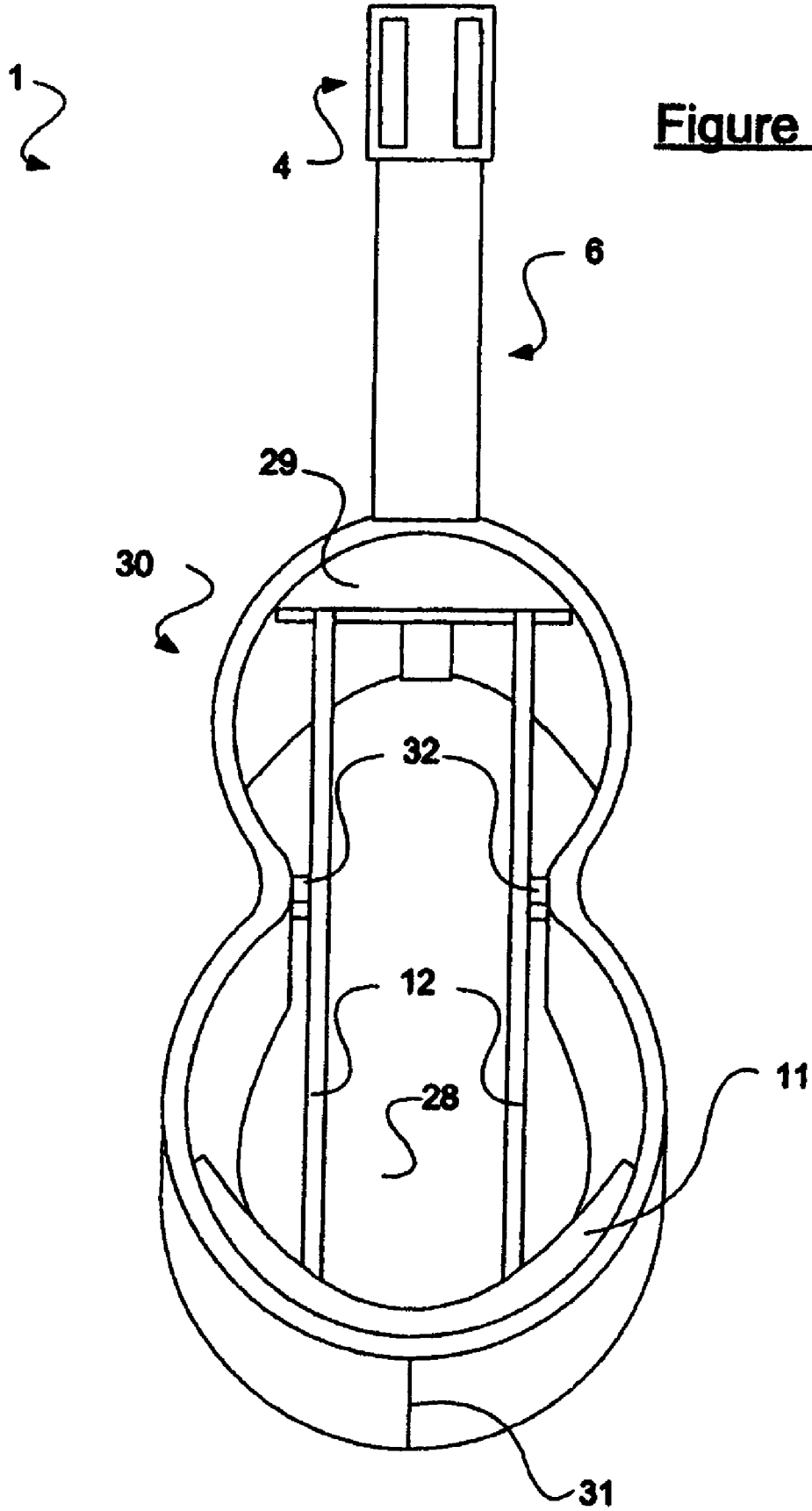
Figure 4:
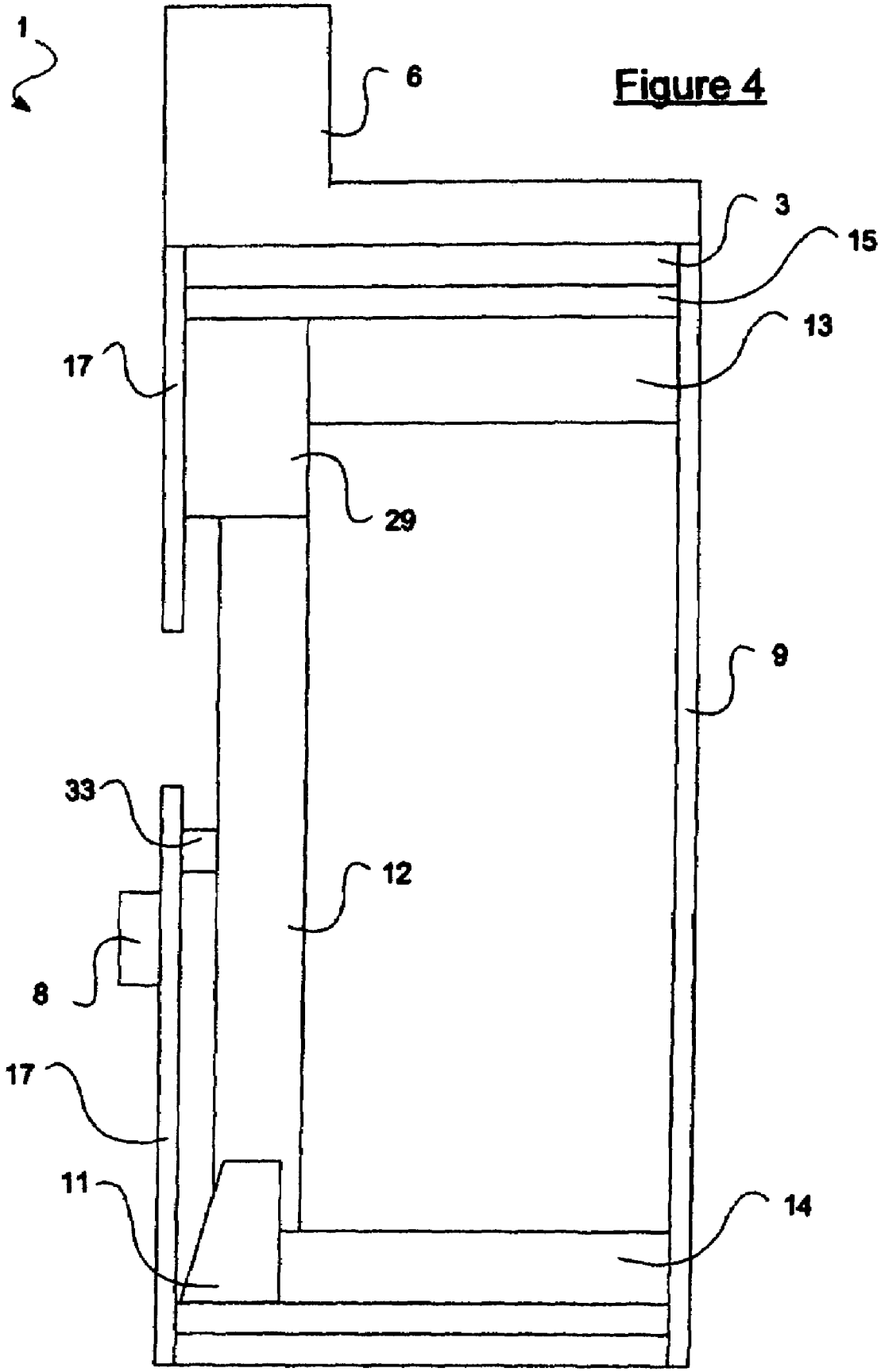

As illustrated in FIGS. 2-4, an interior structure 30 supports the body 24 from movement when the strings 7 load tension on the instrument 1. Within the body 24, multiple supporting spanners 12 are positioned in a mostly parallel alignment with the plane of the strings 7 for spanning an interior cavity 28. In a preferred embodiment, there are two supporting spanners 12, one on each side of a sound hole 2. The neck 6 is further supported by an upper bout header 29 that is attached to heel block 13. The heel block 13 is fit against the outer side laminate 3 after removing a portion of the inner side laminate 15 in which the heel block 13 is recessed The upper bout header 29 and the heel block 13 then integrate with the laminate side assembly out widest point of the upper bout 20. This combination of the upper bout header 29 and laminate side structure 26 improves the stability of the upper bout 20, independently of the top 17. The top 17 then attaches over the upper bout header 29, where the upper bout header 29 traverses the width of the upper bout 20. At the lower end of the body 24, opposite from the upper bout header 29, the instrument 1 has a second beveled lower bout header 11. The lower bout header 11 is a reinforcement platform on which the load of the strings 7 tension rests. Preferably, the lower bout header 11 bevels away from and does not connect to the top 17 and is, instead, integrated with the inner skin 27 of the laminate side structure 26. The spanners 12 are connected between the upper bout header 29 and the beveled lower bout header 11 to provide the rigid interior structure 30. The rigid interior structure 30 supports tension from the strings 7 and isolates the strings tensions at a butt block 14, away from the top 17. The interior structure 30 is also integrated into the laminate side structure 26 at the waist 19 by either direct contact with the spanners 12 or by the addition of a spacer block 32. The laminate side structure 26 is joined at a butt 31 of the instrument 1 and reinforced by the butt block 14, which is glued to either the inner skin 27 or, after recessing the inner skin 27, to the outer side laminate 3. The butt block 14 also connects to a bottom surface of the beveled lower bout header 11 and the back 9.

The inner structure 30 achieves many benefits because it creates a platform at the butt 31 on which string tension is loaded and supported by the spanners 12. Primarily, the inner structure 30 deflects the load of the neck 6 as the neck 6 is cantilevered into the sound hole 2. The inner structure 30 further transfers the load of the strings 7 tension beyond the bridge 8, extending the strings 7 tension through the top 17 of the body 24. As a result, the top 17 or any other analogous structure is left free of compression between the bridge 8 and the sound hole 2. The top 17 is unencumbered from shifting load force created by leverage from the neck 6 into the sound hole 2, and the instrument 1 resists any distorting of the shape of the body 24. The top 17 is accordingly loaded in an isolated fashion to free a larger section of the top 17 for transmission of string vibrations. More specifically, the top 17 is free to resonate over a relatively large area contained by the laminate side structure 26, between the upper bout header 29 and the butt 31 end.

Figure 5:
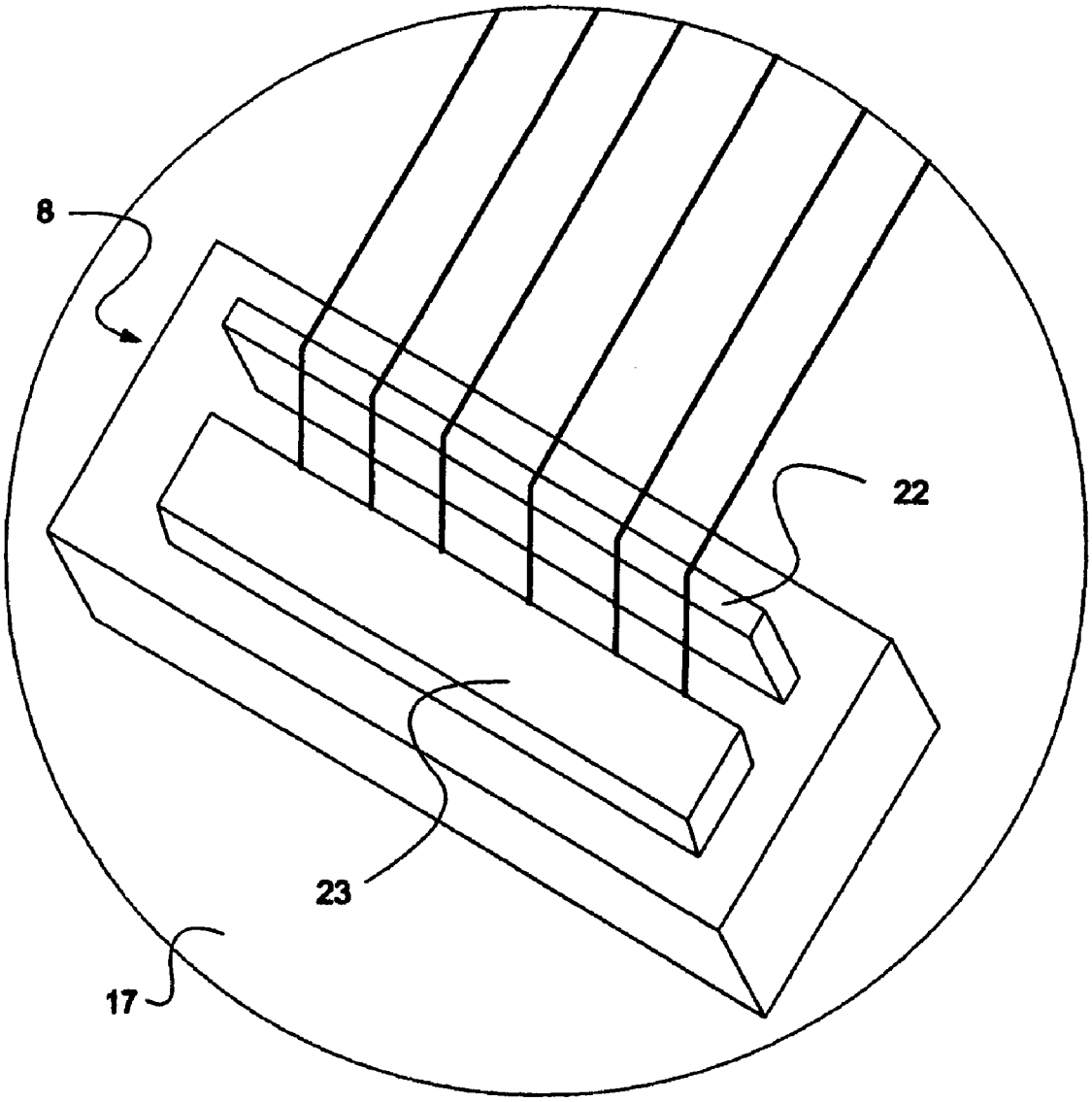

As a result of the design of the instrument 1, the top 17 has fewer structural tasks to perform, compared to known instruments. The top can then be adapted as needed to achieve desired musical performance. As described above, the tasks for the top 17 include supporting the strings 7 force from the center of the lower bout 18 to the butt 31 as an extension of the strings 7 tension. The top 17 further functions to resist a rotational force of the bridge 8 as the strings 7 break over the saddle 22 and connect to the tie block 23, as illustrated in FIG. 5. This rotational force is caused by the angle of the strings 7 breaking over the saddle 22, which lifts the trailing edge of the bride 8 while compressing the leading edge of the bridge 8. In a preferred embodiment, a lateral support brace 33 is added across the top 17 in the lower bout 18 to provide added relief for the top 17 between the bridge 8 and the sound hole 2. The lateral support brace acts as a countermeasure to this rotational force, as well as further controlling string load to free the top 17 for amplitude.

The foregoing description of the preferred embodiments of the invention has been presented for the purposes of illustration and description. It is not intended to be exhaustive or to limit the invention to the precise form disclosed. Many modifications and variations are possible in light of the above teaching. For example, while the elements of the instrument assembly are described as being "glued" together, it should be appreciated that invention includes any known means for attaching elements, including fastening devices (such as bolts, nails, screws or staples) or connecting physical structures (such as dovetails). It is intended that the scope of the invention be limited not by this detailed description but rather by the claims appended hereto. The above specification, examples and data provide a complete description of the manufacture and use of the composition of the invention. Since many embodiments of the invention can be made without departing from the spirit and scope of the invention, the invention resides in the claims hereinafter appended.

What is claimed:

1. A musical instrument with strings, the musical instrument comprising a neck; and a body connected to said neck, said body comprising:

an external structure comprising:

a bridge connected to a proximal end of the strings, a top connected to the bridge, a bottom which is substantially co-planer to the top, and a side structure connected to the top and the bottom, wherein said first header is integrally connected to said side structure, an internal structure, said internal structure comprising:

a first header positioned at a proximal end of the body and integrally connected to said neck and the external structure, a second header positioned at a distal end of the body, and a plurality of spanners connected to the first header and the second header, wherein the spanners receive and disperse both compression and cantilever forces from string tension, and a butt block connected to the second header, the side structure, and the bottom.

2. The musical instrument of claim 1, wherein at least one of the spanners is positioned substantially parallel to the strings.

3. The musical instrument of claim 1, wherein the butt block is connected to the external structure at the distal end of the body, wherein the second header is integrally connected to said butt block and the external structure, and wherein the second header supports tension forces from the strings.

4. The musical instrument of claim 1, wherein the top has a sound hole, and wherein a first of the spanners is positioned on one side of the sound hole and a second of the spanners is positioned on a second, opposite side of the sound hole.

5. The musical instrument of claim 4, wherein the body further comprises a relatively narrow waist section, and wherein the first and second spanners contact the side structure in the waste section.

6. The musical instrument of claim 5, wherein body further comprises a spacer block, wherein the spacer block connects the side structure in the waste section to the first and second spanners.

7. The musical instrument of claim 1, wherein the first header and the second header connect to the side structure.

8. The musical instrument of claim 1, wherein the side structure comprises an inner laminate and an outer laminate.

9. The musical instrument of claim 8, wherein the inner laminate comprises a plurality of kerfs that extend between the top and the bottom.

10. The musical instrument of claim 8, wherein the first header and the second header integrate with the inner laminate.

11. The musical instrument of claim 1, wherein the body further comprises a lateral support brace across the top.

12. The musical instrument of claim 1, wherein the body further comprises a bout, and wherein the first header spans the body at a widest point of the bout.

13. The musical instrument of claim 1 further comprising a heel block that attaches the first header to the neck.

14. The musical instrument of claim 1, wherein said first header and said second header are each affixed to separate distal radiuses of said side structure.

15. A musical instrument comprising one or more tensioned strings;

a bridge connected to a proximal end of the strings;

a resonating top contacting the bridge;

a support means for transferring tension of the strings away from the bridge through the top, and a curved side defining an upper bout and a lower bout separated by a waist portion, wherein the support means comprises a first shelf conforming with a portion of said upper bout and a second shelf conforming with a portion of said lower bout, wherein the first shelf and the second shelf attach to the top, wherein two beams extend between the first shelf and the second shelf to form an intersection with the waist portion.

16. A musical instrument of claim 15, wherein the support structure further includes spacers that connect the beams to the waist portion.

17. The musical instrument of claim 15, wherein said first shelf and said second shelf are each affixed to separate distal radiuses of said curved side.

18. A musical instrument comprising strings and a body comprising:

an internal structure having:

a first header positioned at a proximal end of the body, a second header positioned at a distal end of the body, and a plurality of spanners connected to the first header and the second header;

a bridge connected to a proximal end of the strings;

a top connected to the bridge;

a bottom which is substantially co-planer to the top; and a side structure connected to the top and the bottom, wherein the top has a sound hole at a relatively narrow waist section, wherein a first of the spanners is positioned on one side of the sound hole and a second of the spanners is positioned on a second, opposite side of the side hole, and wherein the first and the second spanners connect to the side structure in the waist section.

19. A musical instrument of claim 18, wherein the support structure further includes spacers that connect the beams to the waist portion.

20. The musical instrument of claim 18, wherein said first header and said second header are each affixed to separate distal radiuses of said side structure.

21. A musical instrument comprising strings and a body comprising: an internal structure having a first header positioned at a proximal end of the body, a second header positioned at a distal end of the body, and a plurality of spanners connected to the first header and the second header, a bridge connected to a proximal end of the strings;

a top connected to the bridge;

a bottom which is substantially co-planer to the top;

a side structure connected to the top and the bottom; and a butt block connected to the second header, the side structure, and the bottom.

22. The musical instrument of claim 21, wherein said first header and said second header are each affixed to separate distal radiuses of said side structure.

* * * * *